US011336020B2

(12) United States Patent
Huang et al.

(10) Patent No.: US 11,336,020 B2
(45) Date of Patent: May 17, 2022

(54) ANTENNA DEVICE

(71) Applicant: PEGATRON CORPORATION, Taipei (TW)

(72) Inventors: Chin-Ting Huang, Taipei (TW); Sony Chayadi, Taipei (TW); Yan-Hua Chen, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 289 days.

(21) Appl. No.: 16/244,253

(22) Filed: Jan. 10, 2019

(65) Prior Publication Data

US 2019/0221942 A1 Jul. 18, 2019

(30) Foreign Application Priority Data

Jan. 15, 2018 (TW) ..... 107101445

(51) Int. Cl.

| | |
|---|---|
| ***H01Q 9/42*** | (2006.01) |
| ***H01Q 9/04*** | (2006.01) |
| ***H01Q 1/48*** | (2006.01) |
| ***H01Q 9/28*** | (2006.01) |
| ***H01Q 5/35*** | (2015.01) |
| ***H01Q 1/24*** | (2006.01) |

(52) U.S. Cl.

CPC ..... *H01Q 9/42* (2013.01); *H01Q 1/243* (2013.01); *H01Q 1/48* (2013.01); *H01Q 5/35* (2015.01); *H01Q 9/0421* (2013.01); *H01Q 9/28* (2013.01)

(58) Field of Classification Search

CPC .. H01Q 9/42; H01Q 9/28; H01Q 5/35; H01Q 1/243; H01Q 1/48; H01Q 9/0421

See application file for complete search history.

(56) References Cited

U.S. PATENT DOCUMENTS

| | | | | |
|---|---|---|---|---|
| 5,898,405 A * | 4/1999 | Iwasaki | H01Q 9/0457 343/846 |
| 6,067,053 A * | 5/2000 | Runyon | H01Q 21/205 343/820 |
| 6,114,996 A * | 9/2000 | Nghiem | H01Q 5/371 343/702 |
| 7,158,090 B2 | 1/2007 | Tang et al. | |

(Continued)

FOREIGN PATENT DOCUMENTS

| | | |
|---|---|---|
| TW | I239682 B1 | 9/2005 |
| TW | 200536186 A | 11/2005 |
| TW | I530022 B | 4/2016 |

*Primary Examiner* — Graham P Smith
*Assistant Examiner* — Jae K Kim
(74) *Attorney, Agent, or Firm* — McClure, Qualey & Rodack, LLP

(57) ABSTRACT

An antenna device is disclosed. The antenna device includes a first metal ground plate, a first field adjustment plate, a second field adjustment plate, a first antenna unit, and a first signal feed source. The first field adjustment plate is connected to a first side of the first metal ground plate, in which the first field adjustment plate and the first metal ground plate form a first angle. The second field adjustment plate is connected to a second side of the first metal ground plate, in which the second field adjustment plate and the first metal ground plate form a second angle. The first antenna unit is connected to the first metal ground plate. The first signal feed source is configured to input a first signal to the first antenna unit.

11 Claims, 7 Drawing Sheets

(56) References Cited

U.S. PATENT DOCUMENTS

2002/0140612 A1* 10/2002 Kadambi ..... H01Q 25/005 343/702
2005/0110699 A1* 5/2005 Timofeev ..... H01Q 1/245 343/797
2005/0140554 A1* 6/2005 Wang ..... H01Q 9/0442 343/702
2006/0033672 A1* 2/2006 Schadler ..... H01Q 13/10 343/770
2006/0082514 A1* 4/2006 Chiang ..... H01Q 19/06 343/794
2006/0092080 A1* 5/2006 Lee ..... H01Q 9/0471 343/700 MS
2006/0279471 A1* 12/2006 Zimmerman ..... H01Q 9/26 343/797
2007/0013593 A1* 1/2007 Zafar ..... H01Q 21/28 343/700 MS
2007/0188400 A1 8/2007 Fujita
2009/0102739 A1* 4/2009 Chang ..... H01Q 1/2291 343/846
2010/0188309 A1* 7/2010 Orime ..... H01Q 21/0075 343/848
2010/0283707 A1* 11/2010 Foo ..... H01Q 9/0414 343/872
2011/0050529 A1* 3/2011 Popugaev ..... H01Q 9/0407 29/600
2011/0207404 A1* 8/2011 Shimasaki ..... H01P 5/18 343/848
2012/0299784 A1* 11/2012 Ayatollahi ..... H01Q 1/243 29/601
2012/0306721 A1* 12/2012 Okegawa ..... H01Q 9/0442 343/905
2014/0210674 A1* 7/2014 Yonei ..... H01Q 9/0471 343/700 MS
2016/0190702 A1* 6/2016 Rucker ..... H01Q 1/246 343/767
2017/0271281 A1* 9/2017 Rodriguez ..... H01L 21/76898
2018/0337461 A1* 11/2018 Kildal ..... H01Q 9/26

* cited by examiner

200

600

ANTENNA DEVICE

RELATED APPLICATIONS

This application claims priority to TAIWAN Application Serial Number 107101445, filed Jan. 15, 2018, which is herein incorporated by reference.

TECHNOLOGY FIELD

The disclosure relates to an antenna device. More particularly, the disclosure relates to an antenna device corresponding to ultra-wide half power beam width.

BACKGROUND

With the advent of the Internet of Things (IoT) generation, wireless base stations may be said to be the most convenient choice for connecting IoT devices to the Internet. The industry's requirements for half power beam width angle for antennas of wireless base stations may be said to be stricter. The ideal demand is that the half power beam width angle is close to 150 degrees, which may make the product have no dead angle for receiving signals, but due to antenna structure limitations, it is unable to be reached.

Therefore, how to design an antenna device that may make an antenna power field width of a magnetic field plane and an electric field plane to be close to 150 degrees to 180 degrees is one of the problems to be improved in the field.

SUMMARY

An embodiment of this disclosure is to provide an antenna device. The antenna device includes a first metal ground plate, a first field adjustment plate, a second field adjustment plate, a first antenna unit, and a first signal feed source. The first field adjustment plate is connected to a first side of the first metal ground plate, in which the first field adjustment plate and the first metal ground plate form a first angle. The second field adjustment plate is connected to a second side of the first metal ground plate, in which the second field adjustment plate and the first metal ground plate form a second angle. The first antenna unit is connected to the first metal ground plate. The first signal feed source is configured to input a first signal to the first antenna unit.

The embodiment of the present disclosure provides an antenna device. More particularly, the disclosure relates to an antenna device corresponding to ultra-wide half power beam width. Through the configuration of the first metal ground plate, the first field adjustment plate, and the second field adjustment plate, the antenna device in the present disclosure may make the half power beam width angle of the antenna radiation pattern of the magnetic field plane and the electric field plane be closed to 150 degrees to 180 degrees, and the signal receiving ability of the antenna device is increased.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
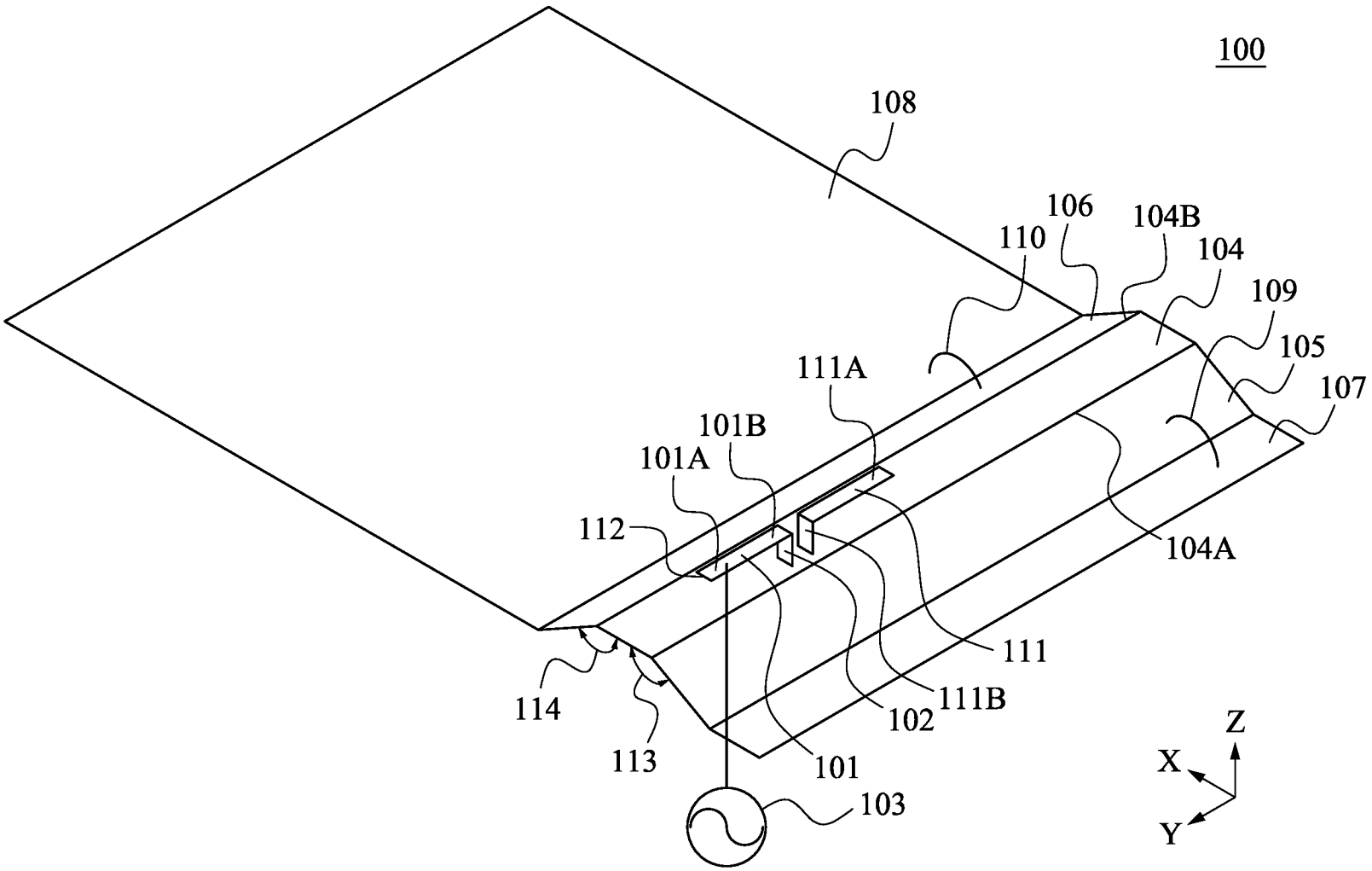
FIG. 1 is a schematic diagram illustrating an antenna device according to some embodiments of the present disclosure.

The following disclosure provides many different embodiments, or examples, for implementing different features of the invention. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention.

Reference is made to FIG. 1. FIG. 1 is a schematic diagram illustrating an antenna device 100 according to some embodiments of the present disclosure. As illustrated in FIG. 1, in some embodiments, the antenna device 100 includes a first metal ground plate 104, a first field adjustment plate 105, a second field adjustment plate 106, a first antenna unit 101, and a first signal feed source 103. The first field adjustment plate 105 is connected to a first side 104A of the first metal ground plate 104. The second field adjustment plate 106 is connected to a second side 104B of the first metal ground plate 104. The first antenna unit 101 is connected to a plane of the first metal ground plate 104. The first signal feed source 103 is configured to input first signal to the first antenna unit 101. In some embodiments, the antenna device 100 further comprises a first field regulator 111. The first field regulator 111 is connected to a plane of first metal ground plate 104.

In some embodiments, the first metal ground plate 104, the first field adjustment plate 105, and the second field adjustment plate 106 are three independent boards.

In some embodiments, the first metal ground plate 104, the first field adjustment plate 105, and the second field adjustment plate 106 are arranged along the X direction. The first antenna unit 101 and the first field regulator 111 are arranged along the Y direction. In some embodiments, the first field regulator 111 does not have triggered resonant mode.

In some embodiments, if the first antenna unit 101 is an inverted F-shaped antenna and the shape of the first field regulator 111 is L shape, the current direction on the L type first field regulator 111 is the inverse direction of the Y direction, and the current direction on the first antenna unit 101 is the direction of the Y direction, and a better field type should be achieved. If the first antenna unit 101 is an antenna of another type, but the current direction on the first antenna unit 101 is still the Y direction, a better field type should also be achieved.

In some embodiments, the first side 101A of the first antenna unit 101 includes an open end 112. The first field regulator 111 is arranged at the second side 101B of the first antenna unit 101.

In some embodiments, the first field adjustment plate 105 and the first metal ground plate 104 forms a first angle 113. The second field adjustment plate 106 and the first metal ground plate 104 forms a second angle 114. By adjusting the angle of the first angle 113 and the second angle 114, the field plane of the magnetic field plane may be changed (XZ plane).

In some embodiments, the first antenna unit 101 is connected to the first metal ground plate 104 through the metal grounding element 102. In some embodiments, by adjusting a length of the first field regulator 111 in the Y direction the electric field plane field type (YZ plane) may be changed. In some embodiments, by adjusting the distance between the first field regulator 111 and the antenna unit 101 in the Y direction, the electric field plane field type (YZ plane) may be changed. The optimum distance between the first field regulator 111 and the first antenna unit 101 on the Y direction is determined by the farthest distance under the field pattern where no concave points are generated as possible.

In some embodiments, the length of the first field regulator 111 from the open end 111A to the ground terminal 111B is a quarter of the wavelength input to the first antenna unit 101 by the signal feed source 103, that is, the length of the first field regulator 111 from the open end 111A to the ground terminal 111B is quarter wavelength resonance.

In some embodiments, if the first antenna unit 101 is an inverted F antenna, the length of the first antenna unit 101 is a quarter of first signal input to the first antenna unit 101 by the signal feed source 103. If the first antenna unit 101 is a planar antenna (patch antenna), the length of the first antenna unit 101 is half of the wavelength of the first signal input to the first antenna unit 101 from the signal feed source 103.

In some embodiments, the antenna device 100 further comprises a second metal ground plate 107 and a third metal ground plate 108. The second metal ground plate 107 is connected to the first field adjustment plate 105. The second metal ground plate 107 and the first field adjustment plate 105 from a third angle 109. The third metal ground plate 108 is connected to the second field adjustment plate 106. The third metal ground plate 108 and the second field adjustment plate 106 from a fourth angle 110.

In some embodiments, the angle of the third angle 109 formed by the second metal ground plate 107 and the first field adjustment plate 105 is the same as the angle of the first angle 113 formed by the first field adjustment plate 105 and the first metal ground plate 104. In some embodiments, the angle of the fourth angle 110 formed by the third metal ground plate 108 and the second field adjustment plate 106 is the same as the angle of the second angle 114 formed by the second field adjustment plate 106 and the first metal ground plate 104.

Figure 2:
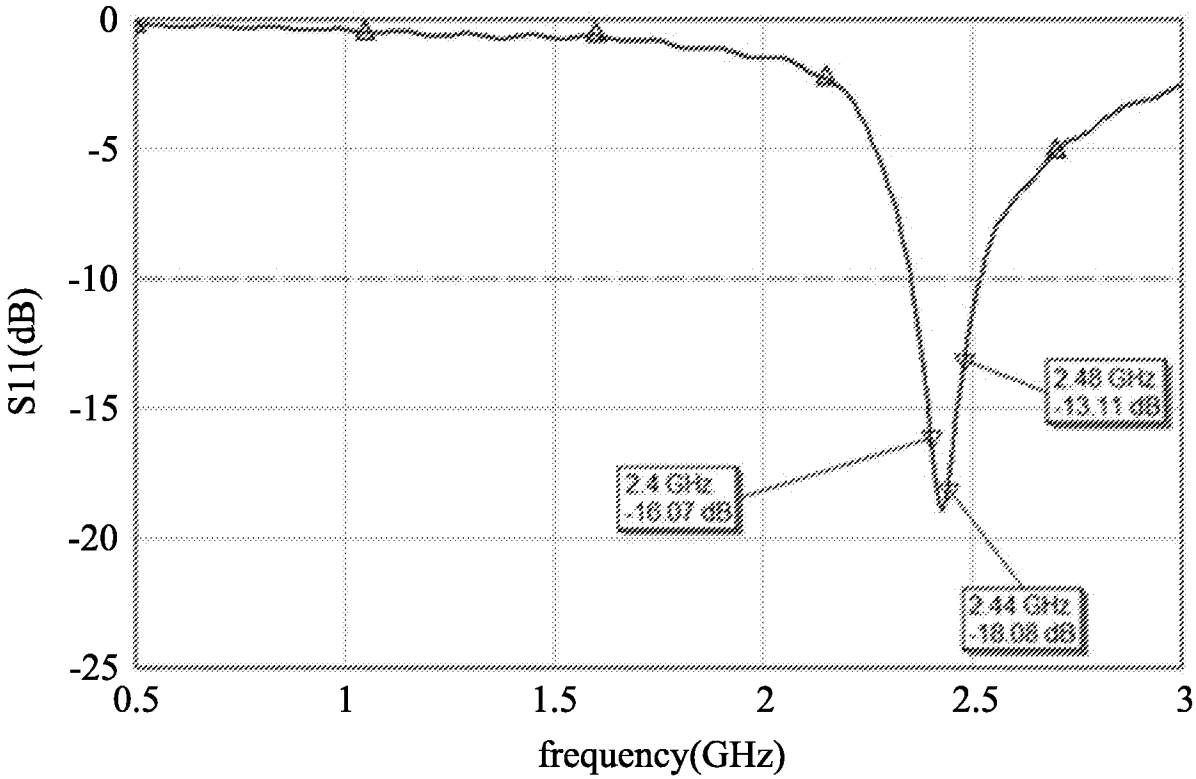
FIG. 2 is an experimental data chart illustrating an experimental data of an antenna device according to some embodiments of the present disclosure.

Reference is made to FIG. 2. FIG. 2 is an experimental data chart 200 illustrating an experimental data of an antenna device 100 according to some embodiments of the present disclosure. FIG. 2 is an experimental data chart 200 of the frequency-reflection loss S11 measured by the network analyzer. It may be known from the experimental data chart 200, and when the frequency is 2440 MHz, the antenna device 100 has minimal reflection loss S11.

Figure 3:
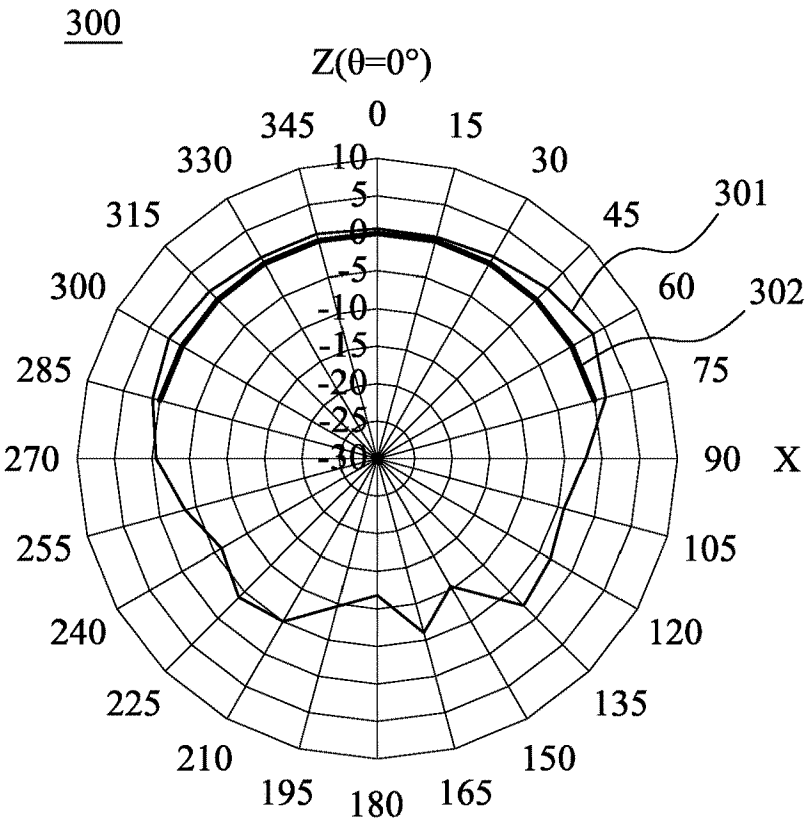
FIG. 3 is a schematic pattern illustrating a magnetic field plane pattern of an antenna device according to some embodiments of the present disclosure.

Reference is made to FIG. 3. FIG. 3 is a schematic pattern illustrating a magnetic field plane pattern 300 of an antenna device 100 according to some embodiments of the present disclosure. FIG. 3 is a magnetic field plane pattern 300 when the antenna device 100 of FIG. 1 is operated at a frequency of 2440 MHz. Curve 301 indicates the magnitude of the magnetic field $H\theta+H\Phi$ on the XZ plane. The curve 302 indicates the range of the half power beam width angle. As illustrated in FIG. 3, the maximum gain of the magnetic field plane is when the angle θ between the X axis and the Z axis is 60 degrees, the magnitude of the magnetic field $H\theta+H\Phi$ at this time is 3.1 dBi. The range of the half power beam width angle is the angle that the magnitude of the magnetic field $H\theta+H\Phi$ is larger or equal to 0.1 dBi. It may be know from FIG. 3, when the angle θ between the X-axis and the Z-axis is in the range of 0 degree to 75 degrees and 285 degrees to 360 degrees, and the magnitude of the magnetic field $H\theta+H\Phi$ is larger or equal to 0.1 dBi, the range of the half power beam width angle that may be achieved is 150 degrees. That is to say, through the configuration of the antenna device 100 in the present disclosure, the range of the half power beam width angle may be at least 150 degrees.

Figure 4:
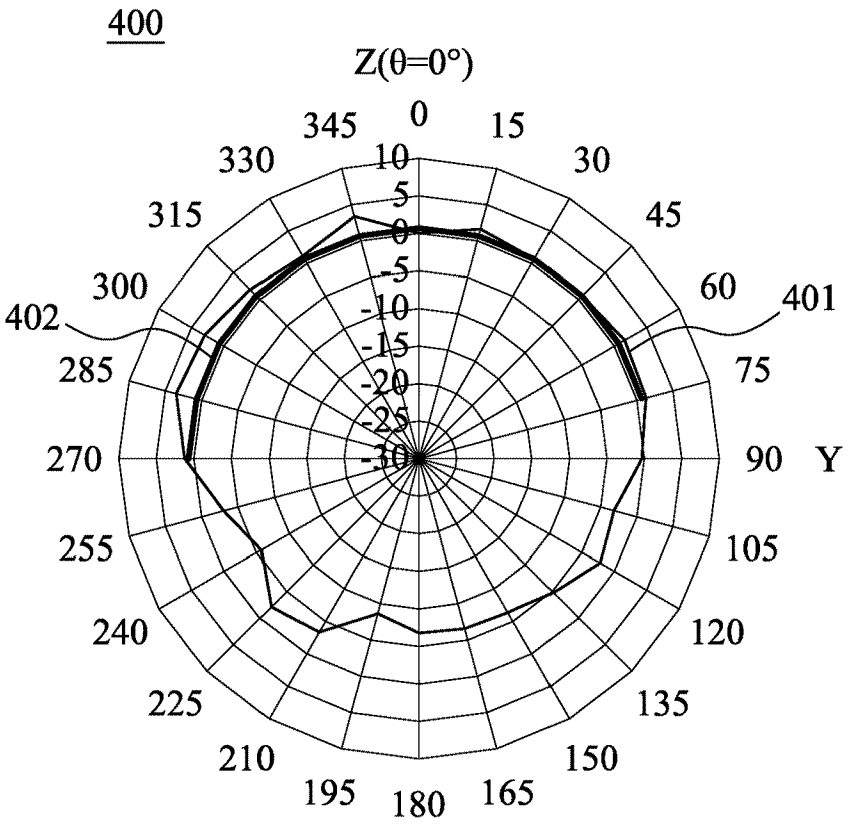
FIG. 4 is a schematic pattern illustrating an electric field plane pattern of an antenna device according to some embodiments of the present disclosure.

Reference is made to FIG. 4. FIG. 4 is a schematic pattern illustrating an electric field plane pattern 400 of an antenna device 100 according to some embodiments of the present disclosure. FIG. 4 is an electric field plane pattern 400 when the antenna device 100 is operated at a frequency of 2440 MHz. Curve 401 indicated the magnitude of the magnetic field $E\theta+E\Phi$ on the YZ plane. The curve 402 indicates the range of the half power beam width angle. As illustrated in FIG. 4, the maximum gain of the electric field plane occurs when the angle θ between the Y axis and the Z axis is 285 degrees, and at this time, the magnitude of the electric field $E\theta+E\Phi$ is 3.5 dBi. The range of the half power beam width angle is the angle when the magnitude of the electric field $E\theta+E\Phi$ is larger or equal to 0.5 dBi. It may be known from FIG. 4, in the range that the angle θ of the Y-axis with respect to the Z-axis is in the range of θ degree to 75 degrees and 270 degrees to 360 degrees, the magnitude of the electric field $E\theta+E\Phi$ is larger than or equal to 0.5 dBi, the range of the half power beam width angle is 165 degrees. That is to say, through the configuration of the antenna device 100 in the present disclosure, the range of the half power beam width angle may be at least 150 degrees.

Figure 5:
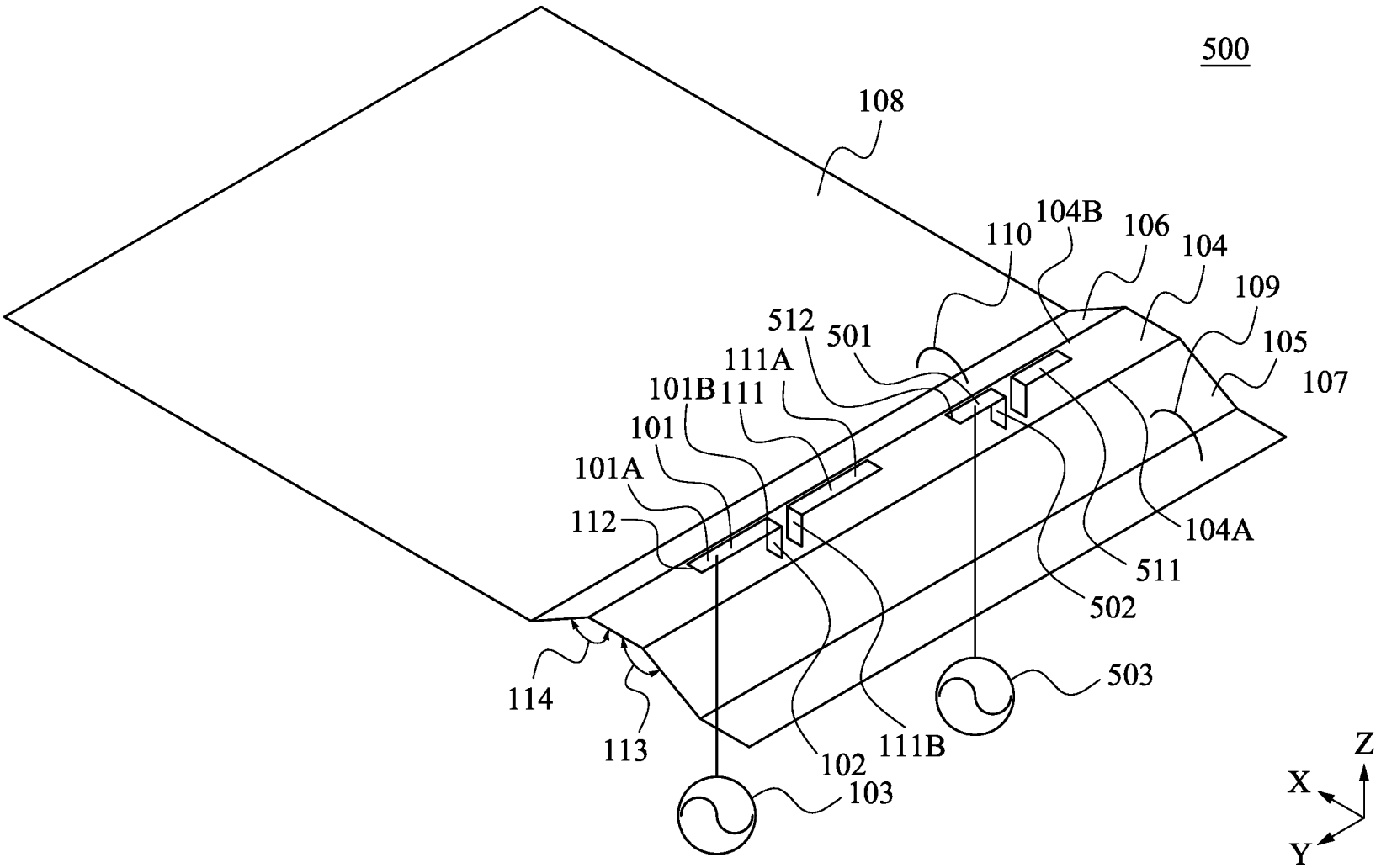
FIG. 5 is a 3D schematic diagram illustrating an antenna device according to some embodiments of the present disclosure.

Reference is made to FIG. 5. FIG. 5 is a 3D schematic diagram illustrating an antenna device 500 according to some embodiments of the present disclosure. In some embodiments, the antenna device 500 further includes a second antenna unit 501, a second signal feed source 503, and a second field regulator 511. The second antenna unit 501 is connected to a plane of the first metal ground plate 104. The second signal feed source 503 is configured to input the second signal to the second antenna unit 501. The second field regulator 511 is connected to the plane of the first metal ground plate 104. In some embodiments, the second antenna unit 501 is connected to the first metal ground plate 104 through the metal grounding element 502.

In some embodiments, the first antenna unit 101, the first field regulator 111, the second antenna unit 501, and the second field regulator 511 are arranged on the first metal ground plate 104 along the Y direction.

In some embodiments, the first signal feed source 103 is different from the signal input by the second signal feed source 503.

Figure 6:
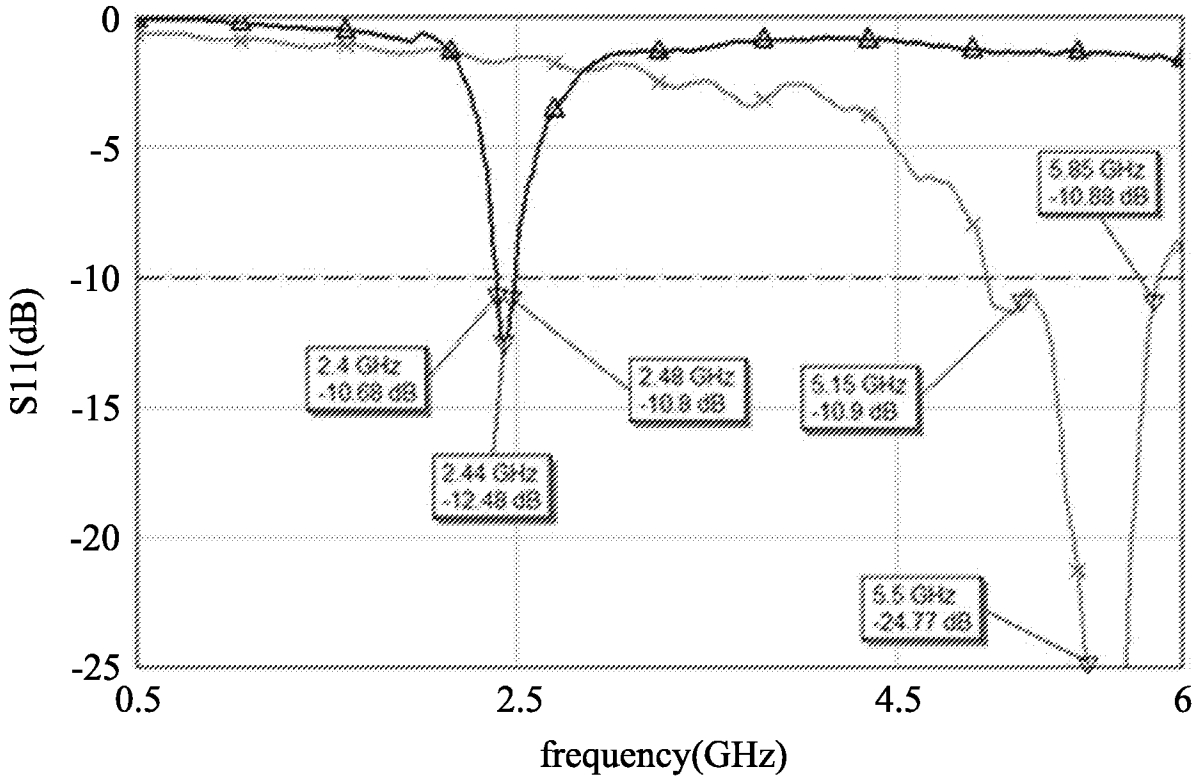
FIG. 6 is an experimental data chart illustrating an experimental data of an antenna device according to some embodiments of the present disclosure.

Reference is made to FIG. 6. FIG. 6 is an experimental data chart 600 illustrating an experimental data of an antenna device 500 according to some embodiments of the present disclosure. FIG. 6 is an experimental data chart 600 of the frequency-reflection loss S11 measured by the network analyzer. It may be known from the experimental data chart 600 that the antenna device 500 has a minimum reflection loss S11 at the frequencies of 2440 MHz and 5500 MHz.

Figure 7:
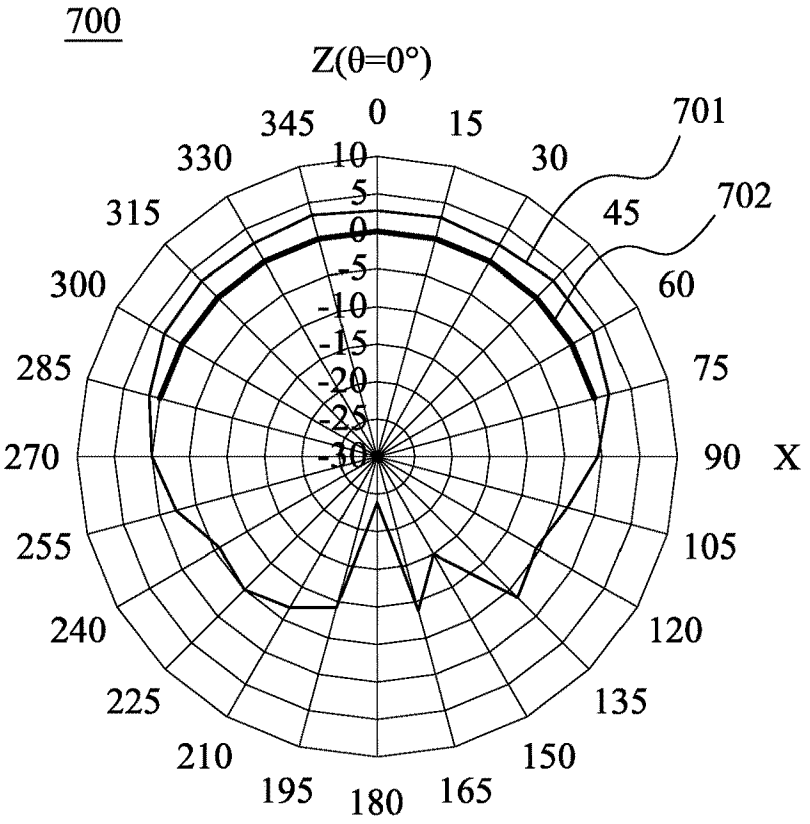
FIG. 7 is a magnetic field plane pattern illustrating an antenna device according to some embodiments of the present disclosure.

Reference is made to FIG. 7. FIG. 7 is a magnetic field plane pattern 700 illustrating an antenna device 500 according to some embodiments of the present disclosure. FIG. 7 is a magnetic field plane pattern 700 when the first antenna unit 101 of the antenna device 500 in FIG. 5 is operated at a frequency of 2440 MHz. The curve 701 indicates the magnitude of the magnetic field Hθ+HΦ on the XZ plane. The curve 702 indicates the range of the half power beam width angle. As illustrated in FIG. 7, the maximum gain of the magnetic field plane occurs when the angle of the X axis with respect to the Z axis is 45 degrees, and at this time, the magnitude of the magnetic field Hθ+HΦ is 3.4 dBi. The range of the half power beam width angle is the angle that the magnitude of the magnetic field Hθ+HΦ is larger or equal to 0.4 dBi. It may be known from FIG. 7, in the range where the angle θ of the X axis with respect to the Z axis is 0 degree to 75 degrees and 285 degrees to 360 degrees, the magnitude of the magnetic field Hθ+HΦ is larger or equal to 0.4 dBi, the range of the half power beam width angle is 150 degrees. That is to say, through the configuration of the antenna device 500 in the present disclosure, the range of the half power beam width angle may achieve at least 150 degrees.

Figure 8:
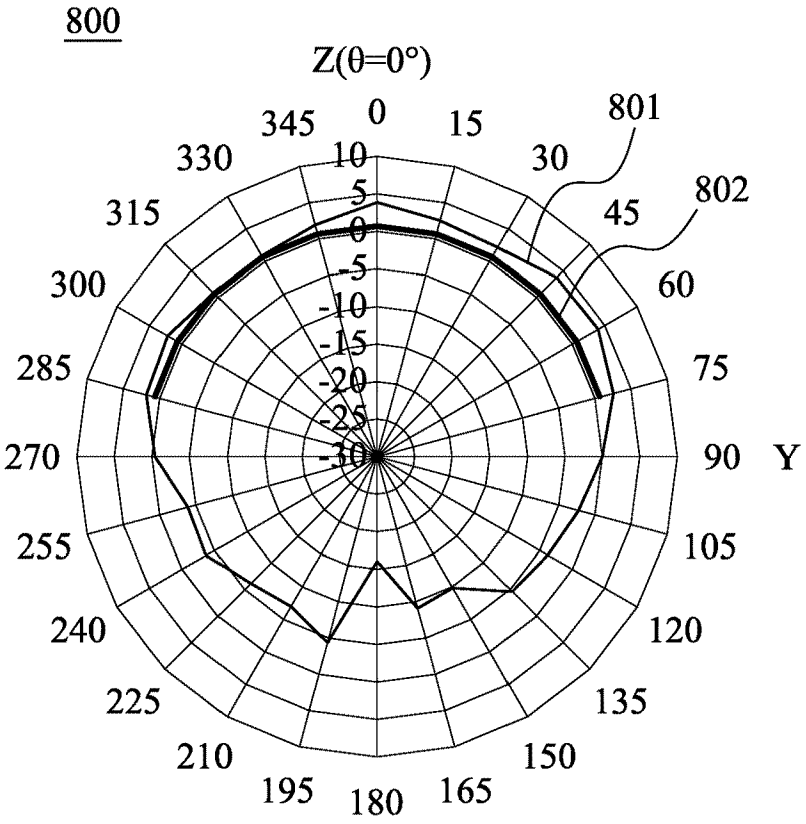
FIG. 8 is an electric field plane pattern illustrating an antenna device according to some embodiments of the present disclosure.

Reference is made to FIG. 8. FIG. 8 is an electric field plane pattern 800 illustrating an antenna device 500 according to some embodiments of the present disclosure. FIG. 8 is an electric field plane pattern 800 when the first antenna unit 101 of the antenna device 500 in FIG. 5 is operated under the frequency of 2440 MHz. The curve 801 indicates the magnitude of the magnetic field Eθ+EΦ on the YZ plane. The curve 802 indicates the range of the half power beam width angle. As illustrated in FIG. 8, the maximum gain of the electric field plane occurs when the angle θ of Y axis withrespect to Z axis is 60 degrees, and at this time, the magnitude of the electric field Eθ+EΦ is 3.8 dBi. The range of the half power beam width angle is the angle that the magnitude of the electric field Eθ+EΦ is larger or equal to 0.8 dBi. It may be known from FIG. 8, in the range where the angle θ of the Y axis with respect to the Z axis is 0 to 75 degrees and 285 to 360 degrees, the magnitude of the electric field Eθ+EΦ is larger than or equal to 0.8 dBi, the range of the half power beam width angle is 150 degrees. That is to say, through the configuration of the antenna device 500, the range of the half power beam width angle may be achieved to be at least 150 degrees.

Figure 9:
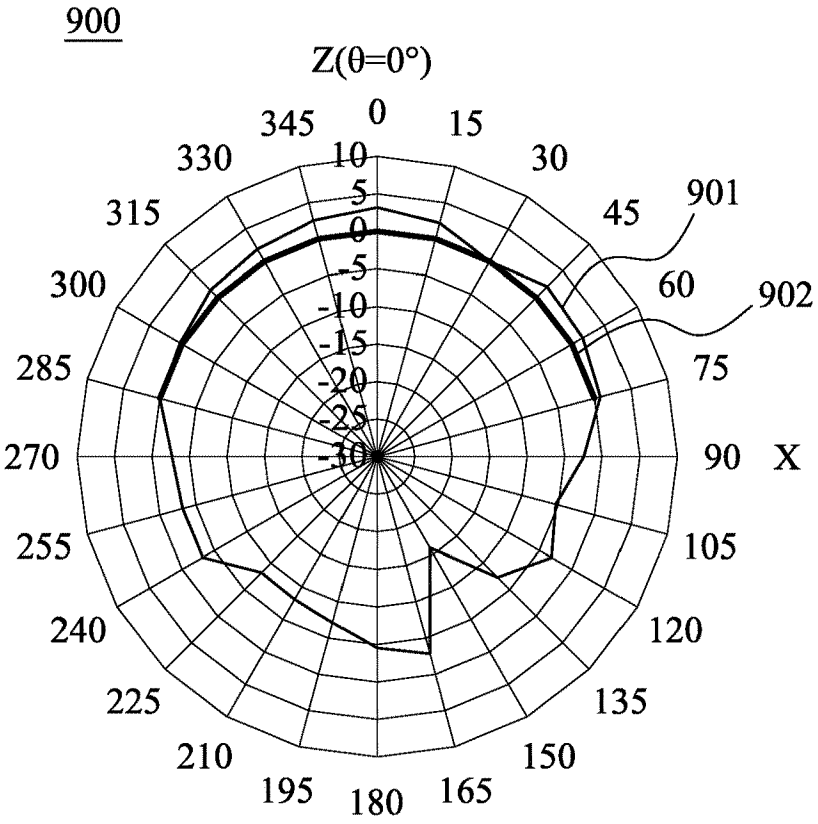
FIG. 9 is a magnetic field plane pattern illustrating an antenna device according to some embodiments of the present disclosure.

Reference is made to FIG. 9. FIG. 9 is a magnetic field plane pattern 900 illustrating an antenna device 500 according to some embodiments of the present disclosure. FIG. 9 is a magnetic field plane pattern 900 when the second antenna unit 501 of the antenna device 500 in FIG. 5 is operated at a frequency of 5500 MHz. The curve 901 indicates the magnitude of the magnetic field Hθ+HΦ on the XZ. The curve 902 indicates the range of half power beam width angle. As illustrated in FIG. 9, the maximum gain of the magnetic field plane occurs when the angle θ of the X axis in respect to the Z axis is 0 degree, at this time, the magnitude of the magnetic field Hθ+HΦ is 3.3 dBi. The range of the half power beam width angle is the angle that the magnetic field Hθ+HΦ is larger or equal to 0.3 dBi. It may be known from FIG. 9, the angle θ between the X-axis in respect to the Z axis is in the range of 0 degree to 75 degrees and 285 degrees to 360 degrees, the magnitude of the magnetic field Hθ+HΦ is larger than or equal to 0.3 dBi, the half power beam width angle may be obtained in the range of 150 degrees. That is to say, through the configuration of the antenna device 500, the range of the half power beam width angle may be at least 150 degrees.

Figure 10:
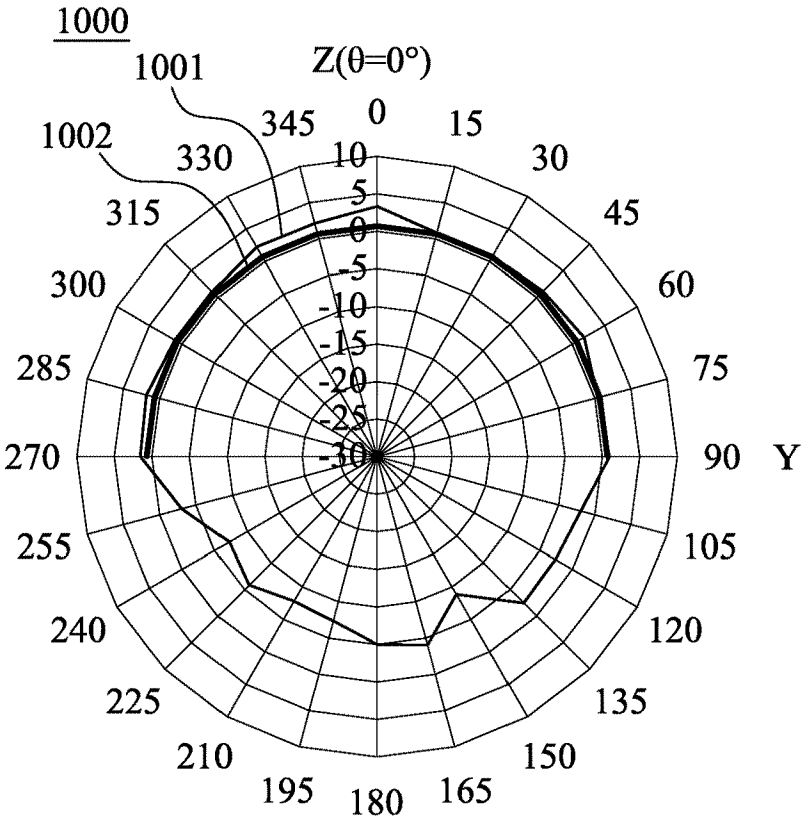
FIG. 10 is an electric field plane pattern illustrating an antenna device according to some embodiments of the present disclosure.

Reference is made to FIG. 10. FIG. 10 is an electric field plane pattern 1000 illustrating an antenna device 500 according to some embodiments of the present disclosure. FIG. 10 is an electric field plane pattern 1000 when the second antenna unit 501 of the antenna device 500 in FIG. 5 is operated at a frequency of 5500 MHz. The curve 1001 indicates the magnitude of the magnetic field Eθ+EΦ on the YZ plane. The curve 1002 indicates the range of the half power beam width angle. As illustrated in FIG. 10, the maximum gain of the electric field plane occurs when the angle θ of the Y axis in respect to the Z axis is 0 degree, at this time, the magnitude of the electric field Eθ+EΦ is 3.1 dBi. The range of the half power beam width angle is the angle that the magnitude of the electric field Eθ+EΦ is larger or equal to 0.1 dBi. It may be known from FIG. 10, in the range of the angle θ of the Y axis in respect to the Z axis is in the range of 0 degree to 90 degrees and 270 degrees to 360 degrees, the magnitude of the electric field Eθ+EΦ is larger or equal to 0.1 dBi, and the range of the half power beam width angle may be obtained to be 180 degrees. That is to say, through the configuration of the antenna device 500, the range of the half power beam width angle may be achieved to be at least 150 degrees.

In some embodiments, the shape of the first field regulator 111 and the second field regulator 511 may be L shape. In some embodiments, the first antenna unit 101 and the second antenna unit 501 are inverted F antennas. In some embodiments, the first antenna unit 101 and the second antenna unit 501 are planar antennas.

In some embodiments, the material of the first antenna unit 101, the second antenna unit 501, the first metal grounding element 102, the second metal grounding element 502, the first metal ground plate 104, the first field adjustment plate 105, the second metal ground plate 107, the second field adjustment plate 106, the third metal ground plate 108, the first field regulator 111 and the second field regulator 511 may composed by metal elements, carbon fiber elements or other conductive materials.

In some embodiments, the first signal feed source 103 and the second signal feed source 503 provides energy to the first antenna unit 101 or the second antenna unit 501, so that the antenna device 100, 500 may transmit and receive wireless communication circuit signals.

Reference is made to Table 1. Table 1 is an experimental data comparison table between the traditional antenna device and the antenna device 500 of the present disclosure.

TABLE 1

| | antenna type | | | |
|---|---|---|---|---|
| | traditional dipole antenna device | traditional inverted F antenna device | antenna device 500 in the present disclosure | |
| operating frequency | 2440 MHz | 2440 MHz | 2440 MHz | 5500 MHz |
| half power beam width angle(magnetic field plane) | 90° | 60° | 150° | 150° |
| half power beam width angle(electric field plane) | 65° | 30° | 150° | 180° |
| maximum gain value | 5.2 dBi | 6.4 dBi | 4.1 dBi | 4.3 dBi |

As illustrated in table 1, compared to the traditional antenna device, the antenna device in the present disclosure may make the half power beam width angle of the antenna radiation pattern of the magnetic field plane and the electric field plane be closed to 150 degree to 180 degree, and the signal receiving ability of the antenna device is increased.

In some embodiments, the antenna device 100, 500 man be integrated in electronic devices with wireless communication capabilities, for example, access point(AP), personal computer(PC) or laptop, but the present disclosure is not limited thereto, any electronic device that may support Multi-input Multi-output (MIMO) communication technology and has communication functions is within the scope of the disclosure.

According to the embodiment of the present disclosure, it is understood that the embodiment of the present disclosure is to provide an antenna device. More particularly, the invention relates to an antenna device corresponding to ultra-wide half power beam width. Through the configuration of the first metal ground plate, the first field adjustment plate, and the second field adjustment plate, the antenna device in the present disclosure may make the half power beam width angle of the antenna radiation pattern of the magnetic field plane and the electric field plane be closed to 150 degrees to 180 degrees, and the signal receiving ability of the antenna device is increased.

In this document, the term "coupled" may also be termed as "electrically coupled", and the term "connected" may be termed as "electrically connected". "Coupled" and "connected" may also be used to indicate that two or more elements cooperate or interact with each other. It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments. As used herein, the term "and/or" includes any and all combinations of one or more of the associated listed items.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An antenna device, comprising:

a first metal ground plate;

a first field adjustment plate, connected to a first side of the first metal ground plate, wherein the first field adjustment plate and the first metal ground plate form a first angle;

a second field adjustment plate, connected to a second side of the first metal ground plate, wherein the second field adjustment plate and the first metal ground plate form a second angle;

a first antenna unit, connected to the first metal ground plate; and a first signal feed source, configured to input a first signal to the first antenna unit;

wherein a first angle formed by the first field adjustment plate and the first metal ground plate and the second angle formed by the second field adjustment plate and the first metal ground plate are oblique symmetry to each other and are not equal to 90 degree;

wherein an antenna radiation pattern is controlled through a configuration of the first metal ground plate, the first field adjustment plate and the second field adjustment plate;

wherein a half power beam width angle of the antenna radiation pattern of a magnetic field plane and an electric field plane of the antenna device is 150 degrees to 180 degrees.

2. The antenna device of claim 1, wherein the first antenna unit is connected to the first metal ground plate through a metal grounding element.

3. The antenna device of claim 1, further comprising:

a second metal ground plate, connected to the first field adjustment plate, wherein an angle between the second metal ground plate and the first field adjustment plate is equal to the first angle; and a third metal ground plate, connected to the second field adjustment plate, wherein an angle between the third metal ground plate and the second field adjustment plate is equal to the second angle.

4. The antenna device of claim 1, wherein the first antenna unit is an inverted F-shaped antenna, and a length of the first antenna unit is a quarter of a wavelength of the first signal.

5. The antenna device of claim 1, wherein the first antenna unit is a planar antenna, and a length of the first antenna unit is half of a wavelength of the first signal.

6. The antenna device of claim 1, further comprising:

a first field regulator, connected to the first metal ground plate.

7. The antenna device of claim 6, wherein the first metal ground plate, the first field adjustment plate and the second field adjustment plate are arranged along a first direction, and the first antenna unit and the first field regulator are arranged along a second direction, wherein the first direction is perpendicular to the second direction.

8. The antenna device of claim 6, further comprising:

a second antenna unit, connected to the first metal ground plate;

a second signal feed source, configured to input a second signal to the second antenna unit; and a second field regulator, connected to the first metal ground plate.

9. The antenna device of claim 8, wherein the first antenna unit, the first field regulator, the second antenna unit and the second field regulator are arranged along a first direction.

10. The antenna device of claim 6, wherein the first antenna unit comprises an open end at a first side, the first field regulator is arranged at a second side of the first antenna unit.

11. The antenna device of claim 6, wherein a shape of the first field regulator is L shape, and a length of the first field regulator is a quarter of a wavelength of the first signal.

* * * * *